United States Patent [19]

Vitale

[11] Patent Number: 4,734,947

[45] Date of Patent: Apr. 5, 1988

[54] FITTED PRODUCT WITH ATTACHED DUST RUFFLE

[75] Inventor: Joseph Vitale, Charlotte, N.C.

[73] Assignee: Perfect Fit Industries, Inc., Monroe, N.C.

[21] Appl. No.: 906,364

[22] Filed: Sep. 11, 1986

[51] Int. Cl.[4] ..... A47G 9/02

[52] U.S. Cl. ..... 5/493; 5/500; 5/502; 150/52 R

[58] Field of Search ..... 5/493, 495, 497, 499, 5/500, 502, 482; 150/52 R; 112/262.1

[56] References Cited

U.S. PATENT DOCUMENTS

| | | | |
|---|---|---|---|
| 1,742,693 | 1/1930 | Coghlan | 5/493 |
| 2,245,779 | 6/1941 | Heil | 5/493 |
| 4,141,097 | 2/1979 | Levinsohn | 5/493 |
| 4,338,693 | 7/1982 | Vitale | 5/497 |
| 4,386,439 | 6/1983 | Roccograndi | 5/493 |
| 4,651,370 | 3/1987 | Vitale | 5/502 |

*Primary Examiner*—Alexander Grosz

*Attorney, Agent, or Firm*—Seidel, Gonda, Goldhammer & Abbott

[57] ABSTRACT

A unitary fitted product having a dust ruffle secured to a peripheral boundary thereof.

4 Claims, 1 Drawing Sheet

FIG. 1
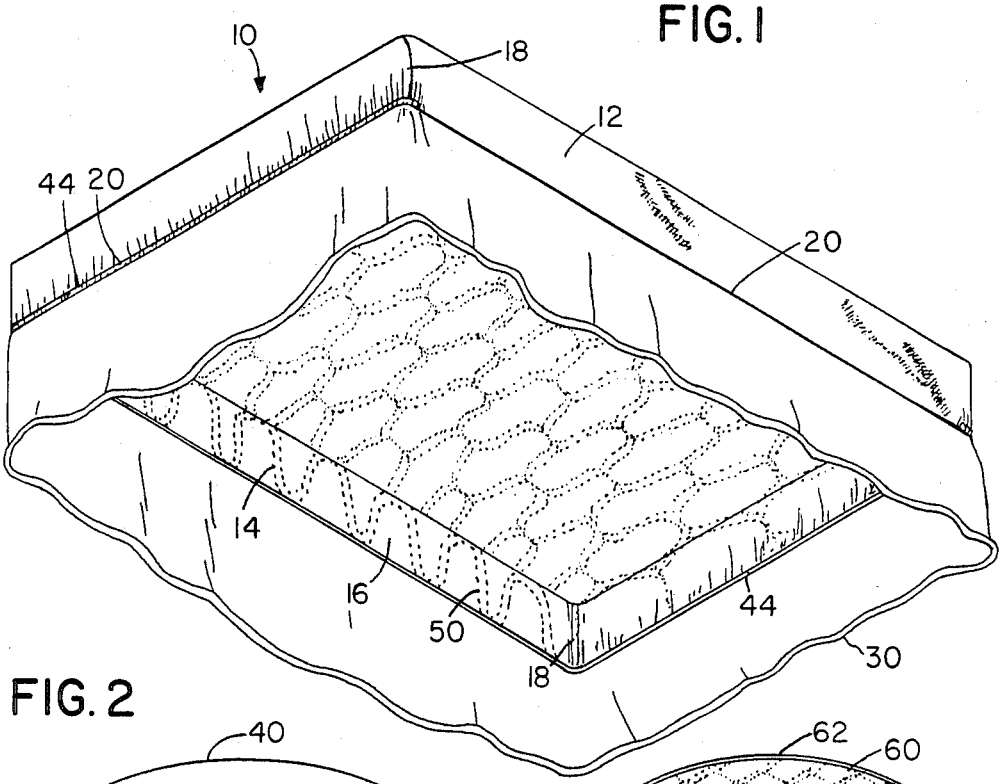
FIG. 2
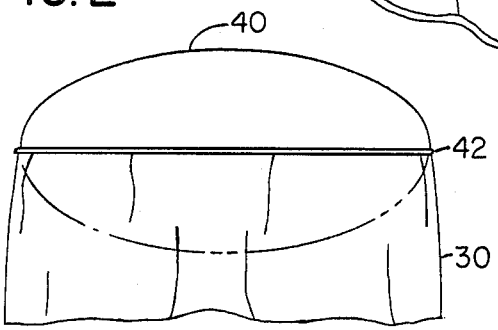
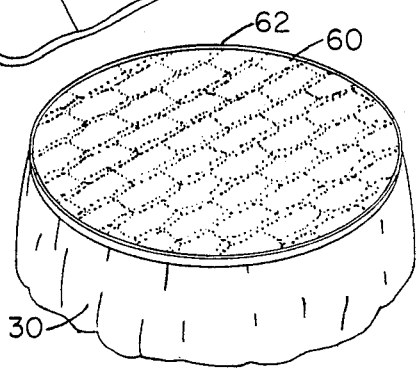
FIG. 3
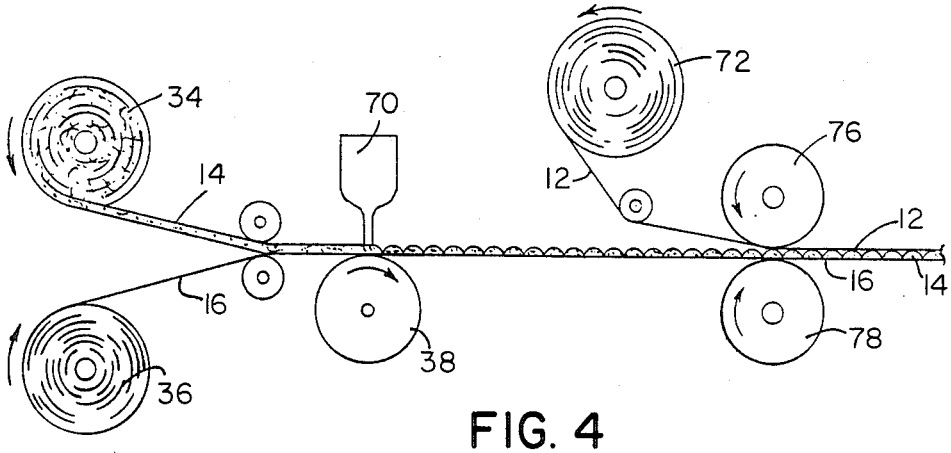
FIG. 4

FITTED PRODUCT WITH ATTACHED DUST RUFFLE

This invention relates to a fitted product having an attached dust ruffle, particularly fitted bed products.

In the past when dust ruffles were employed, they generally required a platform top to support the ruffle, and had roughly the geometric configuration of the surface from which the ruffle was to descend. In the case of a bed, the platform top would be placed on the bed springs and have roughly the same configuration as the bed spring surface. In the case of a table, couch, or sofa, the dust ruffle would be similarly supported and have substantially the same configuration as the underlying object.

In all cases the fabric or other material that supports the dust ruffle is bulky, expensive and adds to the layers of material that must be placed on and removed from the surface by which it is supported. This is an unrewarding and time-consuming chore since the material required to support the dust ruffle is otherwise superfluous. Nevertheless, it must be laundered, cared for and stored as are other household items such as mattress pads, sheets, pillow cases and the like.

In conjunction with fitted products such as mattress pads, bed sheets, mattress and box spring encasements and the like, it is now possible to do away with the cumbersome and otherwise superfluous layer which had no other use than to support a dust ruffle.

SUMMARY OF THE INVENTION

The present invention provides a unitary fitted product having a dust ruffle secured to a peripheral boundary thereof, preferably at a peripheral seam. The unitary fitted product is produced by joining a dust ruffle to the peripheral boundary of the fitted product along a seam substantially defining the shape of the surface from which the dust ruffle is to descend. The fitted product can be a fitted sheet, a mattress pad, an encasement for a mattress or box spring, a fitted case for a pillow such as for example a couch or sofa cushion, or even a protective covering for a table surface. Preferably, the dust ruffle of this invention is attached at the seam into which elasticizing means has been sewn to cause the pad, covering, or sheet to conform to the shape of the substrate to which it is fitted.

A preferred construction is a fitted mattress pad comprising a substantially rectangular fabric backing and a fiberfill batt of substantially the same dimensions as the backing fabric which, if desired, may be quilted to the backing fabric on at least one surface of the batt. A cover of either quilted or unquilted fabric of substantially the same dimension as the backing fabric and fiberfill batt can overlie the fiberfill batt on the surface opposite the backing fabric. The cover is joined to the backing fabric and fiberfill batt along the same around their respective perimeters. Elastic means around at least a portion of the seam are provided to enable the fitted mattress pad to substantially conform to the shape of a mattress and hold the mattress pad in place thereon. The dust ruffle of this invention is joined to the backing fabric and fiberfill batt in a common seam with the elastic means around the perimeter of the pad.

In the case of a fitted bed sheet, the dust ruffle may be attached at a seam extending along the perimeter of the fitted bed sheet. It may also be attached along the peripheral border of the bed sheet which is wholly or partly elasticized to cause the bed sheet to conform to the shape of the mattress. The fitted bed sheet is preferably part of a one-piece fitted bed sheet and mattress pad construction.

Similar constructions can be used to support dust ruffles using pillow encasements for a couch or sofa or using surface coverings for tables.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a perspective view of a unitary quilted mattress pad and dust ruffle of the present invention.

FIG. 2 is a view of a unitary pillow encasement and dust ruffle.

FIG. 3 illustrates a unitary quilted table top protector and dust ruffle of the present invention.

FIG. 4 illustrates a method for manufacturing a preferred fitted product of the invention.

DETAILED DESCRIPTION OF THE INVENTION

Referring to the drawings wherein like numerals indicate like elements, FIG. 1 is a view from below of a unitary construction of the invention. FIG. 1 shows mattress pad 10 having dust ruffle 30 attached thereto at seam 20. FIG. 1 also shows the quilting 50 of a preferred mattress pad of the invention. As shown in FIG. 1, the mattress pad comprises a substantially rectangular backing fabric and a fiberfill batt of substantially the same dimensions as the backing fabric quilted to the backing fabric on at least one surface of the batt. The dust ruffle 30 is joined to the mattress pad at a seam around their respective perimeters, and elastic means around at least a portion of common seam 20 enables the mattress pad to substantially conform to the shape of a mattress.

In a preferred embodiment of the invention, the mattress pad 10 is a one-piece fitted sheet and mattress pad combination comprising a cover 12, a fiberfill batt 14, and a backing fabric 16. The one-piece fitted bed sheet and mattress pad contains a substantially rectangular backing fabric, a fiberfill batt of substantially the same dimensions as the backing fabric quilted to the backing fabric at only one surface of the batt and a cover of unquilted fabric of substantially the same dimensions as the backing fabric batt. The cover loosely overlies the batt on the surface opposite the backing fabric, and is joined to the backing fabric, batt, and dust ruffle along a common seam around their respective perimeters. Alternatively, the cover may be quilted to the batt and the backing fabric. Elastic means is joined around at least a portion of the common seam to enable the one-piece fitted structure to substantially conform to the shape of a mattress and hold the fitted bed sheet, mattress pad and dust ruffle in place on the mattress. Corner seams 18 are provided at the four corners of the one-piece fitted sheet and mattress pad 10 to enable it to more easily conform to the shape of a mattress. Corner seams 18 give one-piece fitted sheet and mattress pad 10 the form of a shallow open box when it is fully extended. A unitary fitted bed sheet and dust ruffle will have somewhat the same configuration as shown in FIG. 1 except that the dust ruffle 30 will be integral with covering sheet 12 alone.

FIG. 2 shows a side view of a fitted pillow encasement 40 having a seam 42 to which dust ruffle 30 is secured. One of the advantages of this configuration is that it provides protection for that portion of a couch or sofa which is most easily soiled by contact with shoes, by household pets, splatters, stains, and the like. Where the dust ruffle is secured to only one face of the pillow, the dust ruffle can be hidden quite easily by turning the face supporting the dust ruffle to the back of the couch when the surface to be protected is no longer vulnerable.

FIG. 3 is a plan view of a quilted table top protector integral with a dust ruffle in accordance with this invention. The surface of the table is protected by a pad 60 which may be constructed in the same manner as the pad in FIG. 1. A common seam 62 secures pad 60 in place on the table surface and supports dust ruffle 30. The seam may also be wholly or partly elasticized.

The padding for the mattress pad in FIG. 1 and pad 60 of FIG. 3 is preferably prepared by joining a fiberfill batt to a backing fabric along a number of bond points by quilting. The batt may be quilted to the backing fabric ultrasonically to directly bond the fibers of the fiberfill batt and the fibers of the backing fabric. The fiberfill batt and backing fabric can also be quilted using other sonic or ultrasonic seaming techniques or it can be quilted conventionally using needle and thread.

In a preferred embodiment of FIG. 1, cover sheet 12 is preferably a layer of bed sheet material placed over the quilted surface of batt 14 and joined together with dust ruffle 30 along seam 20 around the perimeter of cover sheet 12, batt 14, backing fabric 16 and dust ruffle 30. Seam 20 is preferably secured with needle and thread, although sonic or ultrasonic bonding, welding, or any other suitable method of joining these members to one another may be employed. The dust ruffle of this invention may be similarly secured to a fitted bed sheet, pillow, encasement, or other fitted product.

The fitted product with the attached dust ruffle of this invention can be manufactured by any suitable process. One method for manufacturing the preferred unitary construction of FIG. 1, is illustrated in FIG. 4.

As shown in FIG. 4, a one-piece fitted sheet and mattress pad 10 is made in the form of a continuous web which is severed and sewn as more fully described below. Backing fabric 16 is supplied from a backing supply roll 36 and fiberfill batt 14 is supplied from a batt supply roll 34. The batt 14 and backing fabric 16 are brought into contact by anvil roll 38 and ultrasonic bonding head 70. Anvil 38 and ultrasonic bonding head 70 are conventional devices used in ultrasonic bonding. They cooperate to ultrasonically quilt batt 14 to backing fabric 16. After the quilting operation, the cover 12 is fed from cover supply roll 42 and brought into contact with the unquilted surface of batt 14. The web may then be passed through a pair of counter-rotating rollers 76 and 78 to ensure intimate contact between cover 12 and batt 14. It should be noted that cover 12 is not bonded in any way to batt 14 in the preferred embodiment of this invention. However, cover 12 can be bonded or quilted to batt 14 if desired.

After the web leaves counter-rotating rollers 76 and 78, it may be cut into substantially rectangular pieces, the dimensions of which are chosen so that the finished one-piece construction will conform to the desired mattress dimensions. Square segments can be cut away from the four corners of the rectangle and the resulting L-shaped edges sewn together to form side skirts of the desired depth. This forms corner seams 18 to enable the fitted sheet and mattress pad to assume a neat shape and better conform to the rectangular shape of a mattress.

As a final operation, elastic strips 44 are sewn along seam 20 and, at the same time, dust ruffle 30 is secured to the perimeter of the construction along seam 20.

As stated hereinbefore, other fitted products may be provided with the dust ruffle of this invention in a unitary construction using any suitable method as desired. The dust ruffle may be prepared of any suitable material including ordinary bedding material, non-woven polyolefin, or other natural or synthetic fabrics which may also be decorated as desired and/or dyed or otherwise tinted. The dust ruffle may also be single or multi-layered. Further modifications may be made by those skilled in the art without departing from the spirit and scope of the invention except as set forth in the claims.

The present invention may be embodied in other specific forms without departing from the spirit or essential attributes thereof and, accordingly, reference should be made to the appended claims, rather than to the foregoing specification, as indicating the scope of the invention.

I claim:

1. A one-piece fitted product and dust ruffle comprising a backing fabric shaped to conform substantially to the shape of an object to be covered, a fiberfill batt of substantially the same dimensions as the backing fabric quilted to the backing fabric on at least one surface of the batt, a dust ruffle secured to the backing fabric and batt along a common seam around a peripheral boundary thereof and elastic means around at least a portion of the common seam to enable the fitted product to substantially conform to the shape of the object to be covered.

2. A one-piece fitted mattress pad and dust ruffle comprising a substantially rectangular backing fabric, a fiberfill batt of substantially the same dimensions as the backing fabric quilted to the backing fabric on at least one surface of the batt, a dust ruffle joined to the backing fabric and batt along a common seam around their respective perimeters, and elastic means around at least a portion of the common seam to enable the mattress pad to substantially conform to the shape of the mattress.

3. A one-piece fitted bed sheet, mattress pad and dust ruffle comprising a substantially rectangular backing fabric, a fiberfill batt of substantially the same dimensions as the backing fabric quilted to the backing fabric on at least one surface of the batt, a cover of unquilted fabric of substantially the same dimensions as the backing fabric and batt overlying the batt on the surface thereof opposite to the backing fabric, the cover being joined to the backing fabric, batt, and dust ruffle only along a common seam around their respective perimeters, and elastic means around at least a portion of the common seam to enable the bed sheet and mattress pad to substantially conform to the shape of a mattress.

4. A method of manufacturing a one-piece fitted product and dust ruffle comprising the steps of quilting a fiberfill batt to a layer of backing fabric on at least one surface of the batt, placing a layer of unquilted fabric on the batt on the surface of the batt opposite the backing layer, and joining the backing layer, batt, dust ruffle and unquilted fabric together along a common seam defining a substantially rectangular perimeter to form a one-piece fitted bed sheet and mattress pad, the method further comprising the step of attaching elastic along at least a portion of the common seam.

* * * * *